US005689783A

United States Patent [19]

Sasame et al.

[11] Patent Number: 5,689,783

[45] Date of Patent: Nov. 18, 1997

[54] ELASTIC BLADE AND DEVELOPING DEVICE USING THE SAME

[75] Inventors: Hiroshi Sasame, Yokohama; Toru Ishigaki, Ibaraki-ken; Noriyuki Yanai, Yokohama; Tetsuya Kobayashi, Kawasaki; Naoki Enomoto; Yoshiro Saito, both of Yokohama; Arihiro Yamamoto, Tokyo, all of Japan

[73] Assignee: Canon Kabushiki Kaisha, Tokyo, Japan

[21] Appl. No.: 651,894

[22] Filed: May 21, 1996

[30] Foreign Application Priority Data

Jun. 2, 1995 [JP] Japan ..... 7-136820

[51] Int. Cl.[6] ..... G03G 15/08

[52] U.S. Cl. ..... 399/284; 399/274

[58] Field of Search ..... 399/222, 274, 399/284, 252, 350, 174; 430/120

[56] References Cited

U.S. PATENT DOCUMENTS 4,666,815 5/1987 Imai et al. ..... 430/126
4,774,543 9/1988 Yoshikawa et al. .
4,930,438 6/1990 Demizu et al. ..... 399/284 X
4,990,959 2/1991 Yamamuro et al. ..... 399/274
5,202,729 4/1993 Miyamoto et al. .
5,307,127 4/1994 Kobayashi et al. .
5,321,482 6/1994 Yano et al. .
5,353,104 10/1994 Kato et al. .
5,369,478 11/1994 Kobayashi et al. .
5,519,472 5/1996 Ojima et al. ..... 399/274
5,587,776 12/1996 Watabe et al. ..... 399/284
5,604,573 2/1997 Endo et al. ..... 399/222 X

*Primary Examiner*—Sandra L. Brase
*Attorney, Agent, or Firm*—Fitzpatrick, Cella, Harper & Scinto

[57] ABSTRACT

An elastic blade is provided with a rubber layer and a surface resin layer provided on the rubber layer, the surface resin layer satisfying the following condition:

$$3 \leqq E \times t \leqq 30,$$

where

E: elastic modulus of the surface resin layer (Kg/cm$^2$);

t: thickness of the surface resin layer (cm).

10 Claims, 2 Drawing Sheets

ELASTIC BLADE AND DEVELOPING DEVICE USING THE SAME

BACKGROUND OF THE INVENTION

1. Field of the Invention

This invention relates to an elastic blade and a developing device for effecting the regulation of the layer thickness of a developer by the elastic blade.

2. Related Background Art

Heretofore, in image forming apparatuses such as copying apparatuses and printers of the electrophotographic type, there has often been used a developing device using a developer of non-magnetic one component or magnetic one component (hereinafter referred to as the toner). An example of a developing device of the one-component developing type used in an image forming apparatus of the electrophotographic type is shown in FIG. 3 of the accompanying drawings.

As shown, this developing device as provided with a developing chamber 102 having an opening portion 103 in a portion opposed to a photosensitive drum 101, and a toner container 114 containing a toner therein is disposed on the back of the developing chamber 102. There is further provided a partition wall 115 for partitioning the developing chamber 102 and the toner container 114. Also, an electrically conductive developer carrying member (hereinafter referred to as the developing sleeve) 110 is rotatably disposed in the developing chamber 102 in such a manner that a portion thereof is exposed to the opening portion 103, and this developing sleeve 110 is rotated in the direction of the arrow during the developing operation to thereby convey the toner toward the photosensitive drum 101 while carrying the toner thereon.

The developing sleeve 110 is held with a gap of 50 to 500 μm with respect to the photosensitive drum 101 and is formed with a developing area for supplying the toner carried on the developing sleeve 110 toward the photosensitive drum 101. Further, in the developing chamber 102, there is contained a supply roller 112 for supplying the developing sleeve 110 with the toner conveyed from the toner container 114 by conveying means 111.

During the developing operation, a developing bias voltage comprising a DC voltage and an AC voltage superposed one upon the other is applied from a bias voltage source (not shown) to the developing sleeve 110.

Above the developing sleeve 110, there is disposed a developer regulating member (hereinafter referred to as the developing blade) 113 for regulating the layer thickness of the toner carried on the developing sleeve 110. This developing blade 113 is mounted in the developing chamber 102.

During the developing operation, the conveying means 111 conveys the toner toward the supply roller 112 beyond the partition wall 115, and the toner is applied to the developing sleeve 110 by the supply roller 112 rotated in the direction of the arrow. The developing sleeve 110 is rotated in the direction of the arrow and the toner carried on this developing sleeve 110 is regulated to a predetermined layer thickness by the developing blade 113, whereafter it is sent to the developing area opposed to the photosensitive drum 101. In this developing area, the toner is regulated to a predetermined layer thickness from the bias voltage source by the developing sleeve 113, and then is sent to the developing area opposed to the photosensitive drum 101. In this developing area, an electric field is formed by the developing bias supplied from the bias voltage source to the developing sleeve 110, and by this electric field, the toner flies from the developing sleeve 110 toward a region on the photosensitive drum 101 on which an electrostatic latent image is formed, and adheres thereto, whereby the electrostatic latent image is made into a visible image.

It is desirable that the blade 113 be made of such a material that positively gives charges to the toner. For example, when the toner bears the negative polarity, nylon or the like is preferable, and when the toner is charged to the positive, resin or the like of fluorine line is preferable, and a material charged to the polarity opposite to the polarity of the toner is preferable.

However, when the developing blade 113 is constructed by the use of a material such as nylon, the resin is hard and therefore the uniform contact of the blade with the developing sleeve 110 is difficult and thus, the coat of the toner becomes non-uniform. Therefore, irregularity occurs particularly to a half-tone image.

So, it would come to mind to form a resin layer **113*b* on elastic rubber 113*a* as shown in FIG. 4** of the accompanying drawings and achieve the separation of the function of achieving uniform contact by the elasticity of the rubber and effecting the charging of the toner by the resin material on the surface of the rubber.

Even by this technique, however, irregularity could not be completely eliminated. In the past, even this level has passed, but in recent years, for example, in printers, the demand for graphic output has become higher, and with the tendency toward color printing, it has become necessary to improve the level further.

As a result of studies on this point, the following fact has been found.

If the accuracy of the edge surface (the portion A of FIG. 4) of the developing blade is bad, the coat becomes non-uniform. This is considered to be because if the edge surface is uneven, the quantity of toner introduced into a space B for introducing the toner thereinto becomes non-uniform.

Therefore, the blade is cut to thereby make the edge surface smooth, but when a resin layer is on the rubber, the rubber can be neatly cut, while the resin layer is cramped and the end surface of the resin layer in question is disturbed, and this has resulted in the irregularity of the coat of the toner.

The hardness of the resin layer has also affected the irregularity of image.

That is, if the resin material covering the surface is too hard, even if a rubber layer is in the interior, the elasticity thereof is not effectively availed of and uniform contact cannot be accomplished.

If conversely the resin material covering the surface is too soft, the surface of contact will be roughened by wear and the coat of the toner will become non-uniform.

These problems are in relations contrary to one another and have been very difficult to solve.

SUMMARY OF THE INVENTION

It is an object of the present invention to provide an elastic blade which is high in the accuracy of planarity of the end surface thereof.

It is another object of the present invention to provide a developing device which is uniform in the layer thickness of a developer on a developer carrying member.

It is still another object of the present invention to provide an elastic blade comprising:

a rubber layer; and a surface resin layer provided on the rubber layer;

the surface resin layer satisfying the following condition:

$$3 \leqq E \times t \leqq 30,$$

where

E: elastic modulus of the surface resin layer ($kg/cm^2$);

t: thickness of the surface resin layer (cm).

It is yet still another object of the present invention to provide a developing device comprising:

a developer carrying member carrying a developer thereon; and an elastic blade forming a nip with the developer carrying member and regulating the layer thickness of the developer on the developer carrying member;

the elastic blade having a rubber layer and a surface resin layer provided on the rubber layer;

the surface resin layer satisfying the following condition:

$$3 \leqq E \times t \leqq 30,$$

where

E: elastic modulus of the surface resin layer ($kg/cm^2$);

t: thickness of the surface resin layer (cm).

It is a further object of the present invention to provide a manufacturing method comprising the steps of:

preparing a rubber layer;

forming on the rubber layer a resin layer satisfying the following condition:

$$3 \leqq E \times t \leqq 30,$$

where

E: elastic modulus of the resin layer ($kg/cm^2$);

t: thickness of the resin layer (cm); and cutting an elastic plate comprising the resin layer formed on the rubber layer into a predetermined size.

DESCRIPTION OF THE PREFERRED EMBODIMENTS

An embodiment of the present invention will hereinafter be described with reference to the drawings.

Figure 1:
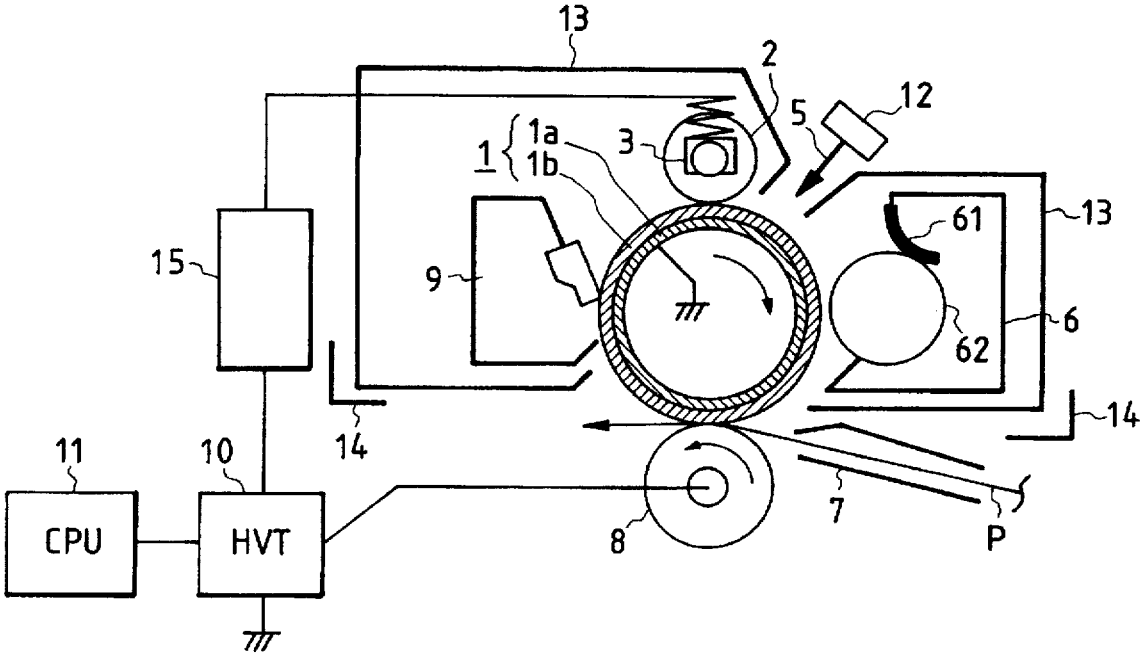
FIG. 1 is a side view showing a developing device having the elastic blade of the present invention mounted therein as it is applied to a process unit removably mountable in an image forming apparatus.

FIG. 1 schematically shows the construction of an example of an image forming apparatus using the developing device of the present invention. This image forming apparatus is a laser beam printer utilizing the transfer type electrophotographic process.

A photosensitive drum 1 which is an image bearing member bearing an electrostatic image thereon is one of a diameter 30 mm having a photosensitive layer 1*b* comprising an organic photoconductive material layer (OPC) on the outer peripheral surface of a drum base body 1*a* made of an electrically conductive material such as grounded aluminum, and is rotatively driven in the direction of the arrow at a predetermined process speed (peripheral speed), e.g. 100 mm/sec. The reference numeral 2 designates a charging roller as a charging member for uniformly charging the photosensitive drum 1, and a vibration voltage which is a voltage comprising a negative DC voltage and an AC voltage superposed one upon the other is applied to the mandrel 3 of this roller by a voltage source 10. At this time, scanning exposure is done by a laser beam 5 outputted from a laser scanner 12 on the basis of image information made into an electrical signal, whereby the potential of the exposed portion is attenuated and an electrostatic latent image is formed on the surface of the photosensitive drum 1. The latent image is developed by a negatively charged toner applied onto a developing sleeve 62 by the developing blade 61 of a developing device 6 so that the latent image may be inversion-developed, that is, the toner may adhere to the exposed portion.

On the other hand, from a paper supply portion, not shown, a transfer material P is fed through a guide 7 to the nip portion (transfer portion) between the photosensitive drum 1 and a transfer roller 8 as a transfer member in timed relationship with the toner image on the surface of the photosensitive drum 1, and the toner image on the surface of the photosensitive drum 1 is sequentially shifted (transferred) to the surface of the transfer material P by a transfer bias of the opposite polarity to the charge polarity of the toner which is being applied from the voltage source 10 to the transfer roller 8.

The transfer material P having passed through the transfer portion is separated from the surface of the photosensitive drum 1, is introduced to fixating means, not shown, is subjected to image fixation there and is outputted as an image-formed material (print).

After the separation of the transfer material, the surface of the photosensitive drum 1 is cleaned by a blade type cleaner 9 which is a cleaning device so that an adhering contaminant such as any residual toner thereon may be removed, and is used repeatedly for image formation. At this time, the pressure of the blade is 25 g/cm.

The reference numeral 11 denotes a control unit (CPU) for automatically setting the bias applying voltage source 10 for the charging roller 2 and the transfer roller 8 to predetermined application timing and predetermined potential.

The charging roller 2, the developing device 6, the cleaner 9 and the photosensitive drum 1 are constructed into an integral unit as a process unit 13. This process unit 13 is removably mountable with respect to the laser beam printer which is an image forming apparatus, and the mounting or dismounting operation thereof may be accomplished by sliding the process unit 13 along a guide 14, i.e., moving it in a direction perpendicular to the plane of the drawing sheet of FIG. 1. The process unit 13, however, may be provided with at least the photosensitive drum 1 and the developing device 6.

The developing device 6 will now be described in detail.

The developing device 6 uses a one-component toner of negative chargeability, and in the present embodiment, uses a non-magnetic toner not containing a magnetic material, because the present embodiment is for color printing.

The toner carried on a developing roll 62 as a developer carrying member by a mirroring force has its layer thickness regulated by a developing blade 61 biased toward a developing roll 62 and is charged to the negative polarity by the friction thereof with the blade 61 and the developing roll 62.

Figure 3:
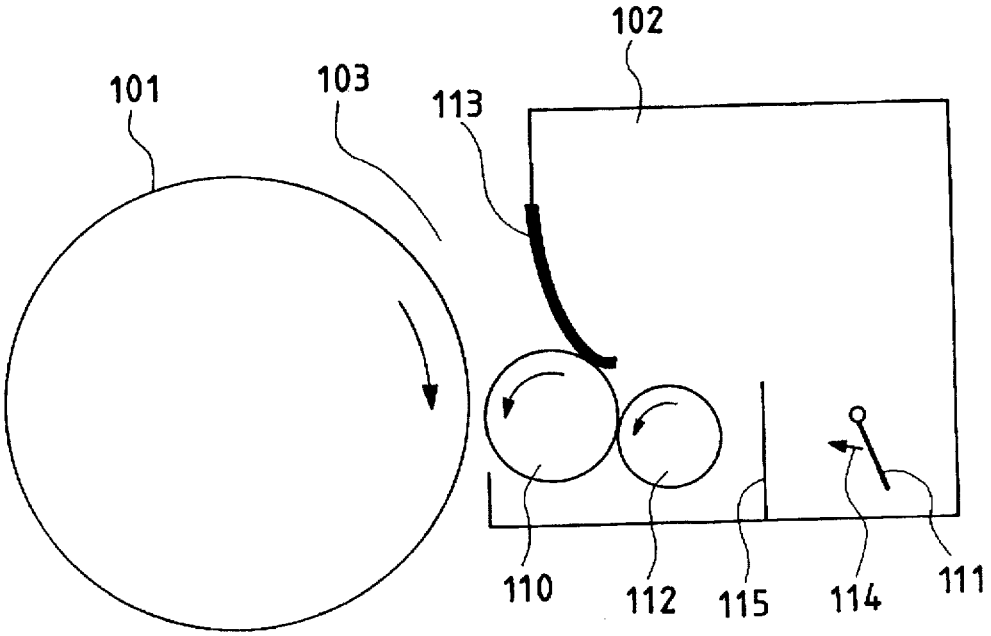
FIG. 3 is a cross-sectional view of an example of a developing device.
Figure 4:
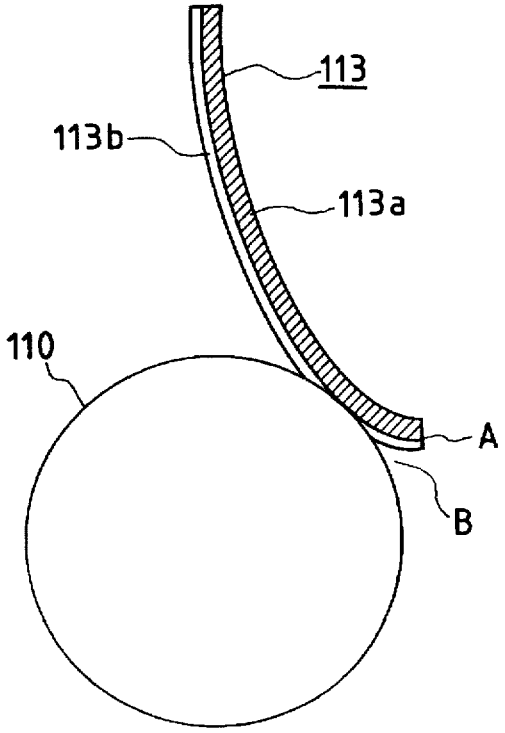
FIG. 4 is a cross-sectional view of an example of an elastic blade.

As in the example of FIG. 3, a bias voltage is applied to the developing roll 62 and the toner on the developing roll 62 flies and inversion-develops the electrostatic image on the photosensitive drum 1.

Figure 2:
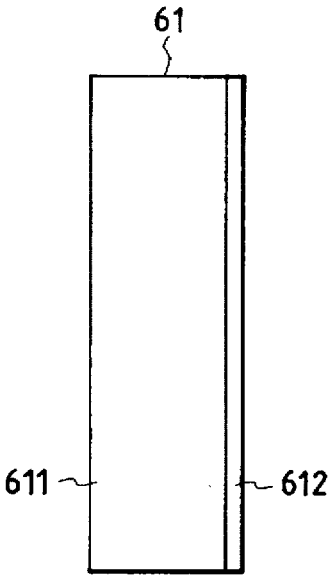
FIG. 2 is a cross-sectional view showing the construction of a developing blade according to an embodiment of the present invention.

FIG. 2 is a view of the developing blade 61 showing a first embodiment of the present invention. In FIG. 2, the reference numeral 611 designates an elastic layer formed of urethane rubber of rubber hardness 65° (by the Wallace hardness meter).

The reference numeral 612 denotes resin as a charge imparting layer for frictionally charging the toner, and in the present embodiment, it is resin of the nylon line for charging the toner to the negative polarity, because a non-magnetic one-component toner of negative chargeability is used in the present embodiment.

At first, a methyl alcohol 20% solution was prepared by the use of Amilan CM4000 (produced by Toray Co., Ltd.), and it was applied to urethane rubber by the dip coating method, was air-dried, and thereafter dried at 80° C.

Thereby, film of nylon was formed on the rubber, whereafter it was cut into a predetermined size.

The elastic modulus of this resin formed as film was 4,000 kg/cm$^2$.

At this time, the film thickness of nylon was 20 μm which enabled ordinary film formation to be accomplished uniformly. Thereafter, all was formed at 20 μm.

Subsequently, By the use of Amilan CM4000 (produced by Toray Co., Ltd.), film of nylon was likewise formed on rubber. The elastic modulus of this resin formed as film was 2,500 kg/cm$^2$.

Likewise, by the use of Toresin (produced by Teikoku Kagaku Industry Co., Ltd.), film of nylon was formed on rubber. The elastic modulus of this resin formed as film was 1,500 kg/cm$^2$.

Further, by the use of AQ Nylon A-70 (produced by Toray Co., Ltd.), film of nylon was formed on rubber. The elastic modulus of this resin formed as film was 500 kg/cm$^2$.

Also, 30 parts by weight of a cross linking agent (melamine formaldehyde resin) and 3 parts by weight of a catalyst (ammonium chloride) were mixed with Amilan CM4000 (produced by Toray Co., Ltd.), and in the same manner as described above, film of cross-linked nylon was formed on rubber. The elastic modulus of this resin formed as film was 10,000 kg/cm$^2$.

Likewise, 50 parts by weight of a cross linking agent (melamine formaldehyde resin) and 5 parts by weight of a catalyst (ammonium chloride) were mixed with Amilan CM4000 (produced by Toray Co., Ltd.) and in the same manner as described above, film of cross-linked nylon was formed on rubber. The elastic modulus of this resin formed as film was 15,000 kg/cm$^2$.

Likewise, 100 parts by weight of a cross linking agent (melamine formaldehyde resin) and 5 parts by weight of a catalyst (ammonium chloride) were mixed with Amilan CM4000 (produced by Toray Co., Ltd.) and in the same manner as described above, film of cross-linked nylon was formed on rubber. The elastic modulus of this resin formed as film was 20,000 kg/cm$^2$.

These were variously made with different elastic moduli and film thicknesses as shown in Table 1 below. Table 1 shows the values of elastic modulus E×thickness t of the respective blades.

TABLE 1

List of E × t

| Film thickness of nylon (μm) | Elastic modulus (kg/cm$^2$) 1500 | 2500 | 4000 | 10000 | 15000 |
|---|---|---|---|---|---|
| 5 | 0.75 | 1.25 | 2 | 5 | 7.5 |
| 10 | 1.5 | 2.5 | 4 | 10 | 15 |
| 15 | 2.25 | 3.75 | 6 | 15 | 22.5 |
| 20 | 3 | 5 | 8 | 20 | 30 |
| 30 | 4.5 | 7.5 | 12 | 30 | 45 |
| 50 | 7.5 | 12.5 | 20 | 50 | 75 |
| 100 | 15 | 25 | 40 | 100 | 150 |
| 500 | 75 | 125 | 200 | 500 | 750 |

Evaluation

The respective developing blades according to Embodiment 1 were evaluated as to the badness of image attributable to the developing blades in the image forming apparatus described in the embodiment. The result is shown in the table below.

TABLE 2

| Film thickness of nylon (μm) | Elastic modulus (kg/cm$^2$) 1500 | 2500 | 4000 | 10000 | 15000 |
|---|---|---|---|---|---|
| 5 | x | x | x | ○ | ○ |
| 10 | x | x | ○ | ○ | |
| 15 | x | ○ | ○ | ○ | |
| 20 | ○ | ○ | ○ | ○ | ○ |
| 30 | ○ | ○ | ○ | ○ | x |
| 50 | ○ | ○ | ○ | x | x |
| 100 | ○ | ○ | x | x | x |
| 500 | x | x | x | x | x |

There is a correlation between this result of evaluation and the values of E×t, and good images are obtained only within the range of $3 \leqq E \times t \leqq 30$.

This is because if the elastic modulus E of the surface resin layer (in the case of the present embodiment, nylon resin) is small when the blade is cut, the resin layer is cramped and the edge portion of the resin layer becomes shaky. However, if the elastic modulus is small but the film thickness t is great, the resin layer will become rigid and therefore will not be cramped and thus, good images will be obtained. This is determined by E×t, and the lower limit value thereof is 3.

If conversely, the elastic modulus E of the surface resin layer is great, the cramping phenomenon during cutting will not occur and the edge will become neat, but if the film thickness t is too great, the resin layer will become too rigid and the elasticity of the rubber layer under it cannot be availed of and uniform contact will become impossible. This also is determined by E×t, and it will be seen that the upper limit value thereof is 30.

A method of measuring this elastic modulus will be shown below.

The elastic modulus of the present invention is measured by a tensile test.

A sample material of a thickness 1 mm and an initial test length 30 mm is prepared.

This sample material is pulled at an elastic stress rate of 100 mm/min. by dumbbell No. 3, and the elastic modulus E kg/cm$^2$ is found from the shrinkage force during 10% stretch.

Next, the elastic modulus of nylon was further experimented within a wide range.

TABLE 3

| | Elastic modulus (kg/cm²) | | | | | | |
|---|---|---|---|---|---|---|---|
| | 500 | 1500 | 2500 | 4000 | 10000 | 15000 | 20000 |
| Image irregularity | x | ○ | ○ | ○ | ○ | ○ | x |

As can be seen from Table 3, it is preferable that the elastic modulus be about 1,000 (kg/cm²) to 15,000 (kg/cm²).

This is because if the elastic modulus is smaller than 1,000 (kg/cm²), the surface of the developing blade will be roughened by the slight frictional contact between the sleeve and the toner and non-uniform coat of the toner will be created, thus resulting in bad images.

If conversely, the elastic modulus is greater than 15,000 (kg/cm²), even if the film thickness t is small, the elasticity of the interior rubber layer will not be availed of and uniform contact will become impossible.

As described above, by $1{,}000 \leqq E \leqq 15{,}000$ being satisfied in addition to $3 \leqq E \times t \leqq 30$, the creation of image irregularity can be prevented more reliably.

While the embodiments of the present invention have been described above, the present invention is not restricted to these embodiments, but all modifications within the technical idea thereof are possible.

What is claimed is:

1. An elastic blade comprising:

a rubber layer; and a surface resin layer provided on the rubber layer;

wherein said surface resin layer satisfies the following condition:

$$3 \leqq E \times t \leqq 30,$$

where

E: elastic modulus of the surface resin layer (kg/cm²);

t: thickness of the surface resin layer (cm).

2. An elastic blade according to claim 1, wherein said rubber layer is urethane rubber, and said surface resin layer is nylon.

3. An elastic blade according to claim 1, wherein said elastic modulus of said surface resin layer is 1,000 to 15,000 kg/cm².

4. A developing device comprising:

a developer carrying member carrying a developer thereon; and an elastic blade forming a nip with said developing carrying member and regulating the layer thickness of the developer on said developer carrying member;

said elastic blade having a rubber layer and a surface resin layer provided on the rubber layer;

wherein the surface resin layer satisfies the following condition:

$$3 \leqq E \times t \leqq 30,$$

where

E: elastic modulus of the surface layer (kg/cm²);

t: thickness of the surface resin layer (cm).

5. A developing device according to claim 4, wherein said developer is a one-component developer of negative chargeability, and the surface resin layer is nylon.

6. A developing device according to claim 5, wherein the rubber layer is urethane rubber.

7. A developing device according to claim 4, wherein the elastic modulus of the surface resin layer is 1,000 to 15,000 kg/cm².

8. A method of manufacturing an elastic blade, comprising the steps of:

preparing a rubber layer;

forming on the rubber layer a resin layer satisfying the following condition:

$$3 \leqq E \times t \leqq 30,$$

where

E: elastic modulus of the resin layer (kg/cm²);

t: thickness of the resin layer (cm); and cutting an elastic plate comprising the resin layer formed on the rubber layer into a predetermined size.

9. A method according to claim 8, wherein the rubber layer is urethane rubber, and the surface resin layer is nylon.

10. A method according to claim 8, wherein the elastic modulus of the surface resin layer is 1,000 to 15,000 kg/cm².

* * * * *

UNITED STATES PATENT AND TRADEMARK OFFICE

CERTIFICATE OF CORRECTION

PATENT NO. : 5,689,783

DATED : November 18, 1997

INVENTOR(S) : Sasame et al.

It is certified that error appears in the above-identified patent and that said Letters Patent is hereby corrected as shown below:

COLUMN 5:

Line 21, "film" should read --a film--.

COLUMN 6:

Lines 28-32, "15000 should read --15000
○ ○
○
○
○" ○--.

COLUMN 7:

Line 17, "and" (second occurrence) should read --and a--; and

Line 44, "said" should read --the--.

Signed and Sealed this

Second Day of June, 1998

*Attest:*

*Attesting Officer*

Bruce Lehman

BRUCE LEHMAN

*Commissioner of Patents and Trademarks*